US008011956B1

(12) United States Patent
Yang et al.

(10) Patent No.: US 8,011,956 B1
(45) Date of Patent: Sep. 6, 2011

(54) WATERPROOF CONNECTOR

(75) Inventors: Cheng-Wang Yang, Guang-Dong (CN); Chao-Yong Ye, Guang-Dong (CN); Kai-Hsiang Chang, Tu-Cheng (TW)

(73) Assignee: Cheng Uei Precision Industry Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/880,060

(22) Filed: Sep. 10, 2010

(51) Int. Cl.
*H01R 13/40* (2006.01)

(52) U.S. Cl. ..... 439/589; 439/607.35

(58) Field of Classification Search ..... 439/589, 439/276, 271, 607.17, 607.35, 607.36, 607.4
See application file for complete search history.

(56) References Cited

U.S. PATENT DOCUMENTS 6,267,623 B1 * 7/2001 Hisamatsu ..... 439/607.35
7,607,947 B1 * 10/2009 Ho ..... 439/607.36
7,922,535 B1 * 4/2011 Jiang et al. ..... 439/607.35

* cited by examiner

*Primary Examiner* — Hae Moon Hyeon
(74) *Attorney, Agent, or Firm* — Cheng-Ju Chiang

(57) ABSTRACT

A waterproof connector includes an insulating housing, a plurality of terminals mounted into the insulating housing, a shell wrapping the insulating housing. The insulating housing has a top wall recessed to form a first through recess having a lower portion with an outer periphery protruded inward for supporting a first sealing plate. The first sealing plate has an outer periphery portion of an upper portion exceeding that of a lower portion thereof. The engagement between the first through recess and the first sealing plate prevent water from going into the insulating housing. A lateral wall is recessed to form a receiving recess. A fixing element fixed in the receiving recess has a damping plate punched outward beyond the lateral wall. The damping plate rests against the lateral slice for stopping the water from permeating into the shell and further spreading into the insulating housing.

5 Claims, 3 Drawing Sheets

WATERPROOF CONNECTOR

BACKGROUND OF THE INVENTION

1. Field of the Invention

The present invention relates to an electrical connector, and more particularly to an electrical connector capable of preventing water from permeating into the connector.

2. The Related Art

A conventional electrical connector includes an insulating housing, a plurality of terminals mounted into the insulating housing, a metal shell wrapping the insulating housing. As the customer is strict about the product performance, the waterproof property is becoming more and more important. The current waterproof product is often provided with a sealing ring made of soft resin between the insulating housing and the shell and achieves waterproof effect by means of the shell pressing the sealing ring. However, the sealing ring is not steady because of the distortion thereof and there may be a crevice at one side of the sealing ring, the waterproof property of the product mentioned above is unsatisfactory and cannot meet customers' demand.

SUMMARY OF THE INVENTION

Accordingly, an object of the present invention is to provide a waterproof connector. The waterproof connector includes an insulating housing, a plurality of terminals mounted into the insulating housing, a shell wrapping the insulating housing. The insulating housing has a top wall and two lateral walls. The top wall is recessed to form a first through recess having a lower portion with an outer periphery protruded inward for engaging and supporting a first sealing plate. The first sealing plate has an outer periphery portion of an upper portion exceed that of a lower portion thereof. The engagement between the first sealing plate and the first through recess prevent water from going into the insulating housing. Each lateral wall is recessed to form a receiving recess. The shell has a top slice, a bottom slice, two lateral slices connecting the top slice and the bottom slice. A plurality of soldering points is formed at the top slice fixing the shell on the insulating housing firmly. A fixing element fixed in the receiving recess has a damping plate extended outward beyond the lateral wall. The damping plate rests against the lateral slice for stopping the water having permeating into the shell further spreading into the insulating housing.

As described above, the engagement of the first sealing plate and the first through recess assures that water cannot permeate into the waterproof connector from a top side of the insulating housing. The fixing element has a damping plate rest against the lateral slice for stopping the water having permeating into the shell further spreading into the insulating housing. So, the waterproof connector can prevent water from permeating into the insulating housing effectively.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
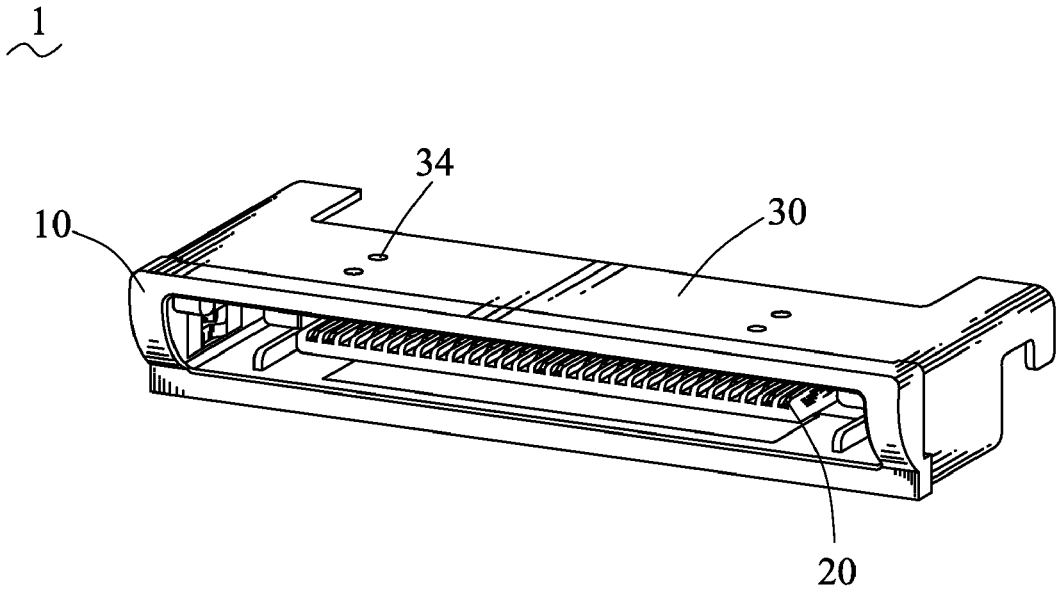
FIG. 1 is an assembled, perspective view of a waterproof connector of an embodiment in accordance with the present invention.
Figure 2:
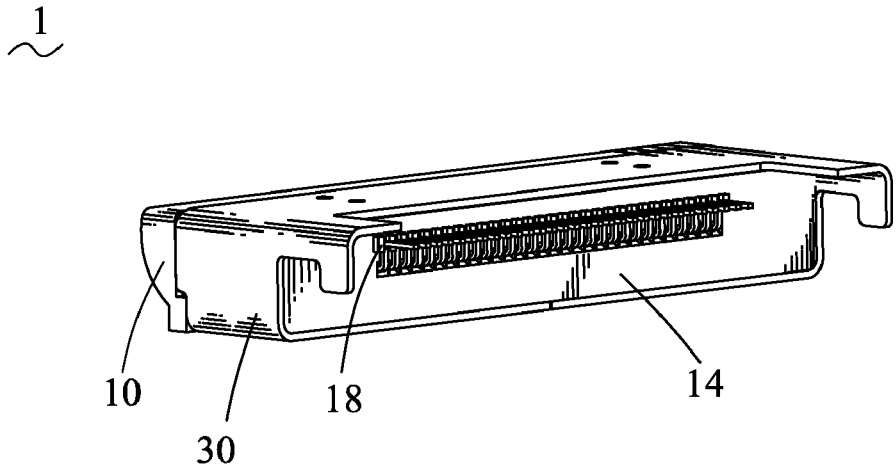
FIG. 2 is an assembled, perspective view of the waterproof connector shown in FIG. 1 seen from another angle.
Figure 3:
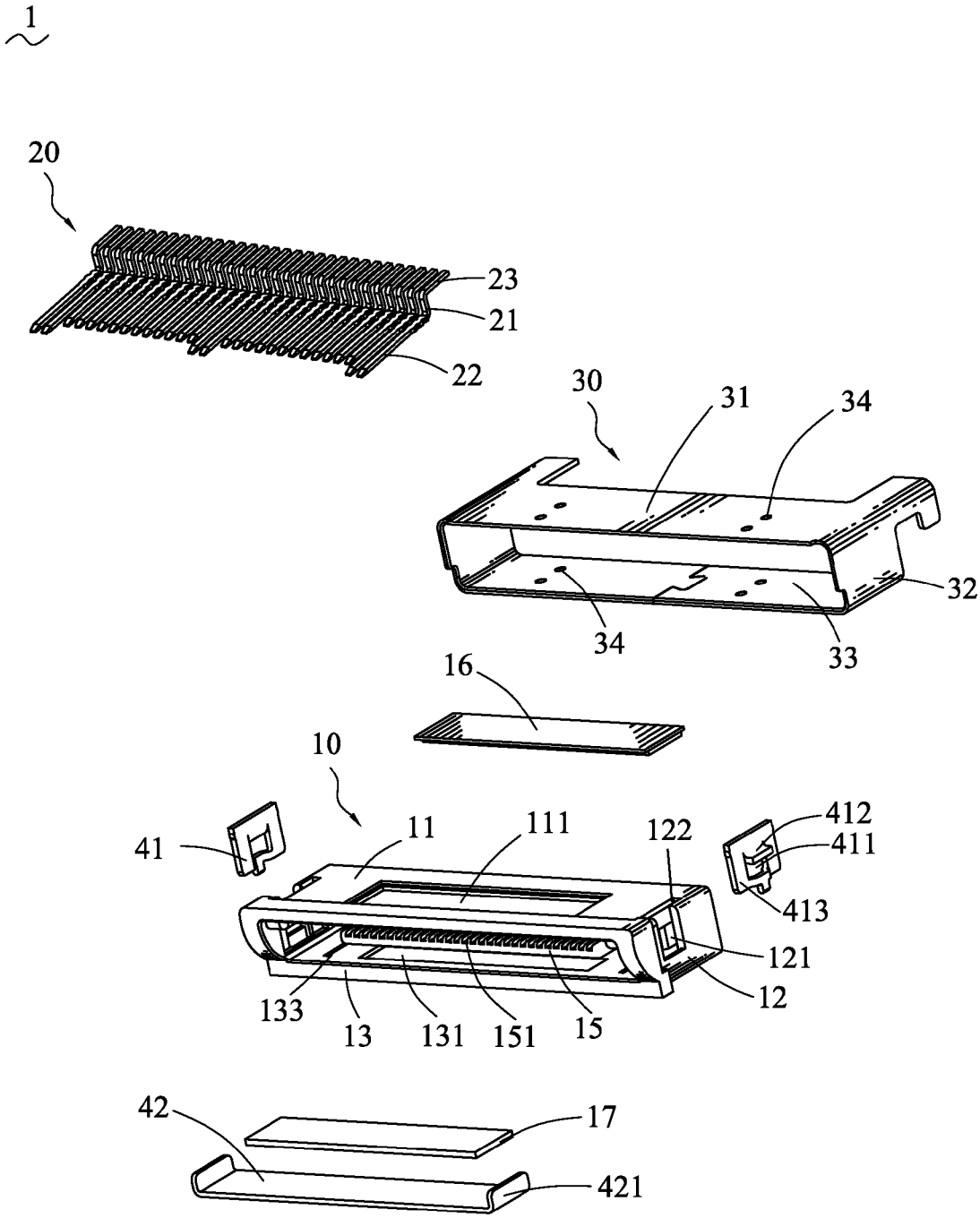
FIG. 3 is an exploded, perspective view of the waterproof connector shown in FIG. 1.
Figure 4:
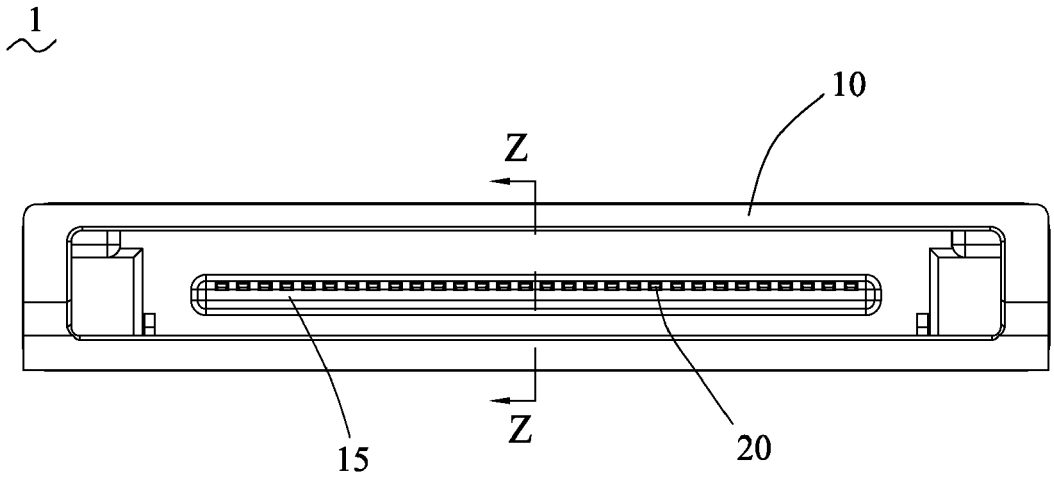
FIG. 4 is an assembled, front view of the waterproof connector shown in FIG. 1.
Figure 5:
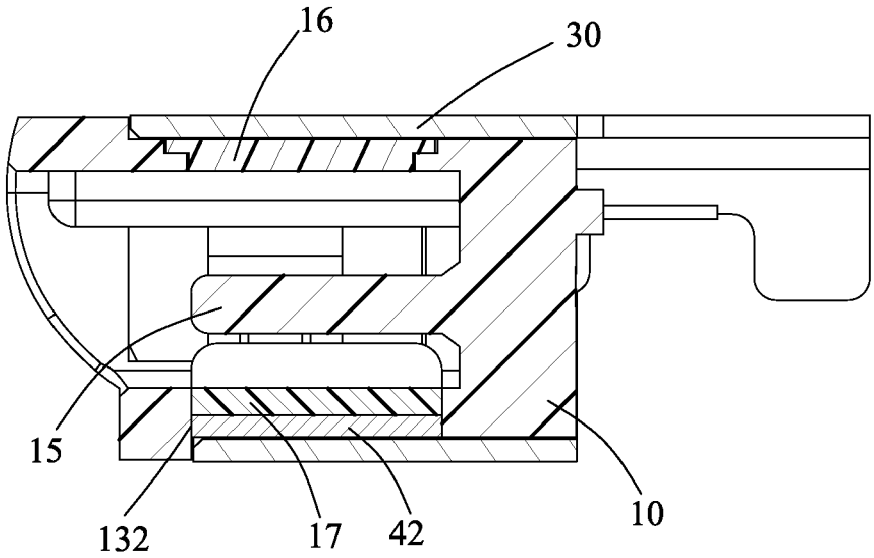
FIG. 5 is a cross-sectional view of the waterproof connector shown in FIG. 4.

Referring to the drawings in greater detail, and first to FIGS. 1-3, the embodiment of the invention is embodied in a waterproof connector 1. The waterproof connector 1 has an insulating housing 10, a plurality of terminals 20 mounted into the insulating housing 10, a shell 30 wrapping the insulating housing 10.

The terminal 20 has a contacting portion 22. A rear end of the contacting portion 22 is extended upward to form a fixing portion 21. A free end of the fixing portion 21 is extended rearward to form a soldering portion 23.

The shell 30 has a top slice 31. Two opposite ends of the top slice 31 are extended downward to form two lateral slices 32. Bottom ends of the lateral slices 32 are connected by a bottom slice 33. A plurality of soldering points 34 is formed at the top slice 31 and the bottom slice 33.

A fixing element 41 has a base plate 413. A middle portion of the base plate 413 is punched to form a rectangular through hole 411. A top of the through hole 411 is extended outwardly and perpendicularly to the base plate 413 to form a damping plate 412. A supporting plate 42 has two opposite ends thereof extended upward to form fixing ends 421.

Referring to FIGS. 2-5, the insulating housing 10 has a top wall 11, two lateral walls 12, a bottom wall 13 and a rear wall 14. A substantially middle portion of the top wall 11 is recessed to form a first through recess 111 for receiving a first sealing plate 16. An outer periphery portion of an upper portion of the first sealing plate 16 exceeds a lower portion of the first sealing plate 16 a little. Corresponding to the structure of the first sealing plate 16, the first through recess 111 has a lower portion with an outer periphery protruded inward for engaging and supporting the first sealing plate 16. The bottom wall 13 is recessed to form a second through recess 131 through the bottom wall 13 at a substantially middle portion thereof for receiving a second sealing plate 17. A lower portion of the second through recess 131 has two opposite ends thereof extending opposite to each other and beyond the second through recess 131 to form a receiving space 132. The receiving space 132 has two opposite ends extending upward and through the bottom wall 13 to form a pair of fixing grooves 133. A middle portion of each lateral wall 12 is recessed to form a receiving recess 121 with an open top end. The receiving recess 121 has an inner portion thereof enlarged towards two opposite sides to form a buckling recess 122 for receiving the fixing element 41. A tongue 15 is protruded frontward from the rear wall 14. A plurality of terminal grooves 151 is formed at the tongue 15 extending frontward and rearwards. The terminal grooves 151 extend through the rear wall 14. A plurality of holding portions 18 is protruded rearward from the rear wall 14 and paralleled with each other for fixing the terminals 20.

In assembly, the contacting portion 22 is received in the terminal groove 151, the fixing portion 21 has a top portion thereof fixed between the nearest two holding portions 18, so the terminals 20 are fixed on the insulating housing 10. The first sealing plate 16 is placed in the first through recess 111. The second sealing plate 17 is placed in the second through recess 131, and is fixed by the supporting plate 42 by means of the fixing end 421 inserted in the fixing groove 133. The fixing element 41 is fixed in the insulating housing 10 by means of the base plate 413 buckling with the buckling recess 122. The damping plate 412 rests against the lateral slice 32 for stopping the water having permeating into the shell 30 from spreading into the insulating housing 10. The soldering points 34 formed at the top slice 31 fix the top slice 31 firmly on the first sealing plate 16, the soldering points 34 formed at the bottom slice 33 fix the bottom slice 33 firmly on the supporting plate 42, so the shell 30 is fixed on the insulating housing 10 firmly.

As described above, the holes on the insulating housing 10 are only on the rear wall 14 for assembling the terminals 20, and the holes are very small. The engagement of the first sealing plate 16 and the first through recess 111 assures that water cannot permeate into the waterproof connector 1 from a top side of the insulating housing 10. The second sealing plate 17 is placed in the second through recess 131 and fixed by the supporting plate 42 firmly, so water cannot permeate into the waterproof connector 1 from a bottom side of the insulating housing 10. The fixing element 41 fixed in the buckling recess 122 has a damping plate 412 rest against the lateral slice 32 of the shell 30 for stopping the water having permeating into the shell 30 further spreading into the insulating housing 10. So, the waterproof connector 1 can prevent water from permeating into the insulating housing 10 effectively. The first sealing plate 16 and the second sealing plate 17 made of metal are durable, also, the friction is small when a plug connector is inserted into the waterproof connector 1.

What is claimed is:

1. A waterproof connector, comprising:

an insulating housing having a top wall and two lateral walls, the top wall recessed to form a first through recess having a lower portion with an outer periphery protruded inward for engaging and supporting a first sealing plate, the first sealing plate having an outer periphery portion of an upper portion exceeding that of a lower portion thereof, the engagement between the first sealing plate and the first through recess preventing water from going into the insulating housing, each lateral wall recessed to form a receiving recess;

a plurality of terminals mounted into the insulating housing;

a shell wrapping the insulating housing having a top slice, two opposite sides of the top slice extended downward to form a pair of lateral slices, a bottom slice connecting bottom ends of the lateral slices; and a fixing element fixed in the receiving recess having a damping plate extended outward beyond the lateral wall to rest against the lateral slice for stopping the water from permeating into the shell and further spreading into the insulating housing.

2. The waterproof connector as claimed in claim 1, a bottom wall of the insulating housing is recessed to form a second through recess for receiving a second sealing plate of plate shape.

3. The waterproof connector as claimed in claim 2, wherein a lower portion of the second through recess has two opposite ends thereof extending opposite to each other and beyond the second through recess to form a receiving space, the receiving space has two opposite ends extending upward through the bottom wall to form a pair of fixing grooves, the waterproof connector further comprises a supporting plate received in the receiving space, the supporting plate has two opposite ends thereof extended upward to form a pair of fixing ends, the supporting plate is fixed in the receiving space for supporting the second sealing plate by means of the fixing ends being inserted in the fixing grooves.

4. The waterproof connector as claimed in claim 3, wherein a plurality of soldering points is formed at the bottom slice fixing the bottom slice on the supporting plate.

5. The waterproof connector as claimed in claim 1, wherein a plurality of soldering points is formed at the top slice fixing the top slice on the first sealing plate.

* * * * *